US008333584B2

(12) United States Patent
Cook

(10) Patent No.: US 8,333,584 B2
(45) Date of Patent: Dec. 18, 2012

(54) BURNER CONTROL

(75) Inventor: Richard D. Cook, North Ridgeville, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 1337 days.

(21) Appl. No.: 11/443,827

(22) Filed: May 31, 2006

(65) Prior Publication Data

US 2007/0099136 A1 May 3, 2007

Related U.S. Application Data

(60) Provisional application No. 60/731,075, filed on Oct. 28, 2005.

(51) Int. Cl.
*F23D 14/72* (2006.01)
*F23N 5/24* (2006.01)

(52) U.S. Cl. ..... 431/6; 431/12; 431/18; 431/37; 431/77; 122/14.2; 122/14.21; 122/14.22; 700/299

(58) Field of Classification Search ..... 431/75–80, 431/27, 12, 6, 18, 37; 122/14.2, 14.21, 14.22; 700/299
See application file for complete search history.

(56) References Cited

U.S. PATENT DOCUMENTS

| | | | | | |
|---|---|---|---|---|---|
| 3,277,949 | A * | 10/1966 | Walbridge | 431/6 |
| 3,335,382 | A * | 8/1967 | Forbes | 338/22 R |
| 3,584,988 | A * | 6/1971 | Hirsbrunner et al. | 431/66 |
| 3,818,285 | A * | 6/1974 | Carson et al. | 361/162 |
| 4,281,789 | A * | 8/1981 | Quinlisk | 236/44 C |
| 4,389,184 | A * | 6/1983 | Tanaka et al. | 431/15 |
| 4,583,936 | A * | 4/1986 | Krieger | 431/1 |
| 4,974,180 | A * | 11/1990 | Patton et al. | 700/292 |
| 4,984,736 | A * | 1/1991 | Reiser et al. | 237/2 A |
| 5,121,880 | A * | 6/1992 | Adams et al. | 237/12 |
| 5,791,890 | A * | 8/1998 | Maughan | 431/6 |
| 5,857,262 | A * | 1/1999 | Bonnema et al. | 34/97 |
| 6,030,205 | A * | 2/2000 | Maughan | 431/29 |
| 6,363,868 | B1 * | 4/2002 | Boswell et al. | 110/213 |
| 6,824,383 | B2 * | 11/2004 | Cain | 431/12 |
| 6,880,493 | B2 * | 4/2005 | Clifford | 122/14.22 |
| 6,881,055 | B2 * | 4/2005 | Bird | 431/80 |
| 6,958,689 | B2 * | 10/2005 | Anderson et al. | 340/525 |
| 7,243,489 | B2 * | 7/2007 | Johnson et al. | 60/297 |
| 7,390,338 | B2 * | 6/2008 | Simpson, Jr. | 55/282.3 |

* cited by examiner

*Primary Examiner* — Steven B McAllister
*Assistant Examiner* — Daniel E Namay
(74) *Attorney, Agent, or Firm* — Tarolli, Sundheim, Covell & Tummino LLP

(57) ABSTRACT

A fuel-fired appliance is shut down when a predicted steady state combustion chamber temperature is below a known threshold. The predicted steady state temperature is based on combustion chamber temperatures during heat up of the burner and appliance.

17 Claims, 5 Drawing Sheets

BURNER CONTROL

CROSS REFERENCE TO RELATED APPLICATIONS

This application claims the benefit of priority from U.S. Provisional Patent Application Ser. No. 60/731,075 filed on Oct. 28, 2005.

TECHNICAL FIELD

The invention concerns generally the field of burners for use on fuel-fired appliances and more particularly a control system for atmospheric premixed low emission burners.

BACKGROUND

Fuel-fired appliances must meet numerous safety standards. For example, current generation water heaters must be flammable vapor ignition resistant, or FVIR. A common approach to constructing an FVIR water heater is to pass all of the combustion air through a flame arrestor prior to mixing with the supplied fuel. In this manner, the fuel burner is isolated from the environment, reducing the risk of ignition of flammable vapors that could be in the environment. Flame arrestors can become fouled from lint, dirt, and oil (LDO) during the appliances operational lifetime. This flame arrestor fouling can starve the combustion process for air, causing carbon monoxide to be produced. Due to the risk of carbon monoxide production, standards also require that fuel-fired appliances be equipped with some means of shutting the appliance off if the combustion process may be producing excessive carbon monoxide. Some water heaters include shut off mechanisms that are triggered by increased operating temperature, which is one indication that the combustion air is being limited.

Some new cleaner fuel burning appliances have burner systems in which all the needed combustion air is provided through the main burner. Secondary combustion chamber relief openings are provided to enhance combustion stability and emissions performance. Because of airflow and thermal balances, this style of appliance will exhibit a decrease in operational temperatures in the event that the burner becomes fouled, making previously known carbon monoxide shut-off mechanisms that are triggered by increased operational temperatures ineffective.

SUMMARY

A fuel-fired appliance is shut down when a predicted steady state combustion chamber temperature is below a known threshold. The predicted steady state temperature is based on combustion chamber temperatures during heat up of the burner and appliance.

A method and apparatus is provided for use with an appliance that includes a combustion chamber enclosing a burner that selectively disables the burner when certain criteria are met. A temperature is monitored within the combustion chamber during a heating cycle and a rate of change of temperature is compared to a threshold rate. The burner is disabled if the rate of change of temperature is below a threshold rate.

The threshold rate may be calculated by compiling an average rate of change of temperature during a first n number of heating cycles of the appliance and setting the threshold rate to a proportion of the compiled average. In addition, disablement of the burner may be prevented if the combustion chamber temperature is above a minimum temperature. The minimum temperature can be determined by taking a proportion of an average operating temperature experienced during the first n number of heating cycles of the appliance. A counter may be incremented for each heating cycle in which the rate of change of temperature falls below the threshold rate and the burner disabled when the counter reaches a preset number.

In one case, the rate of change of temperature is compared to the threshold rate by storing an array of target temperatures and corresponding elapsed operation times that represent a rate of change of temperature that indicates normal operation of the appliance and collecting an actual temperature from the combustion chamber at each of the elapsed operation times. The collected actual temperature is compared to the stored target temperature corresponding to the elapsed operation time. A number of actual temperatures that are sufficiently close to the stored temperature so as to indicate normal appliance operation are counted and the burner is disabled when more than a given number of actual temperatures are not sufficiently close to the stored temperature. The stored temperatures may be calculated by averaging temperature values that occur at each elapsed operating time during a first number of heating cycles of the appliance and taking a proportion of each averaged temperature value corresponding to a lower end of a range of expected operating temperatures. In this instance, the temperature may be monitored by periodically obtaining a set of temperature data points and selecting a temperature data point from the n samples that has the median temperature value. The selected median value is compared with a maximum temperature value and the burner is disabled if the selected median value exceeds the maximum temperature value. The selected median value is returned for comparison with the threshold rate if the selected median value is below the maximum temperature value.

Once the temperature is above the minimum operating temperature, the temperature may continued to be monitored to detect a decrease in temperature at a decrease rate that exceeds a threshold decrease rate. A counter is then incremented each time the decrease rate exceeds the threshold and the burner is disabled when the counter reaches a predetermined count. A signal from an external sensing device such as a carbon dioxide detector or fire detection system may also be monitored and the burner may be disabled when the sensing device detects one or more predetermined burner shut-down conditions.

A microprocessor may be employed to monitor temperature and compare the temperature to the stored values. To conserve power, the microprocessor may be placed in an operating mode prior to monitoring the temperature and comparing the rate of change of temperature and then, optionally, placing the microprocessor in a power saving mode after the temperature is compared to the threshold rate. This technique is especially advantageous when the microprocessor is powered with a thermopile or one or more batteries.

These and other objects, advantages, and features of the exemplary embodiment of the invention are described in detail in conjunction with the accompanying drawings.

DETAILED DESCRIPTION

The burner control system described herein takes advantage of the fact that in some combustion systems, the steady state combustion chamber temperature will be reduced when the burner becomes fouled with LDO. When the predicted steady state combustion chamber temperature is below a passing threshold temperature, the burner control system shuts down the burner before air starvation can cause excessive carbon monoxide production.

During a normal combustion cycle, the combustion chamber in an appliance, such as a water heater, starts from a cold condition and heats over time to a steady state hot condition. The first part of the cycle is characterized by a rapid temperature climb followed by a leveling off of temperature as the combustion chamber nears the steady state or maximum temperature. At the end of the combustion cycle, the fuel is shut off and a reverse of this heating process takes place. During normal operation of a water heater, the combustion cycle is normally shorter than the time it takes to reach the steady state temperature.

Figure 2:
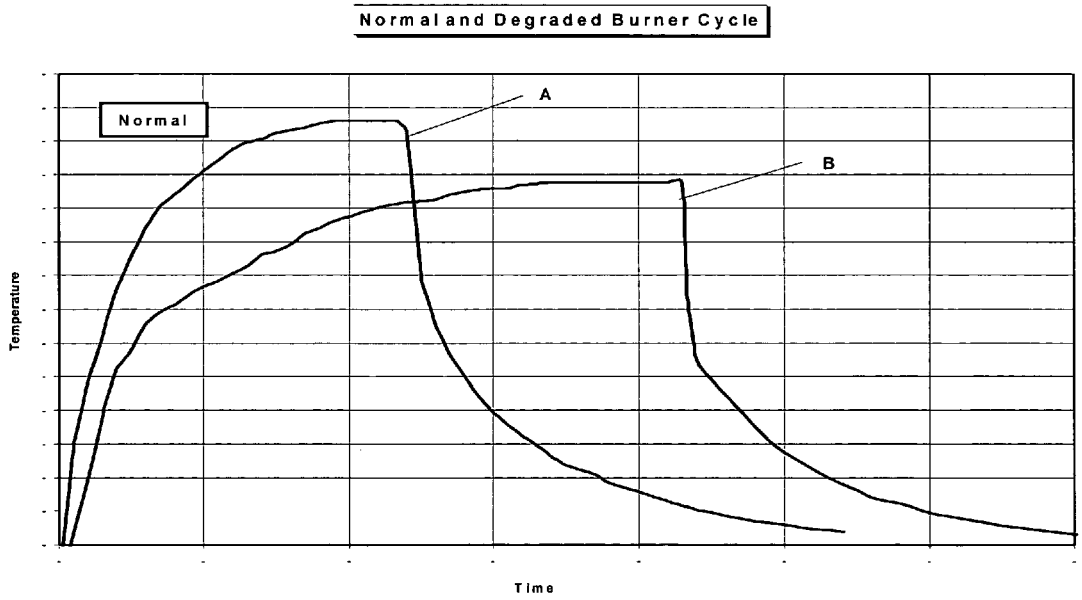
FIG. 2 is a graph comparing burner operational temperatures between a baseline burner and a burner having degraded performance due to LDO fouling.

Since the water heater combustion chamber rarely reaches steady state temperature, steady state temperature can not be directly used as a reliable indicator of burner condition. The burner control system described herein advantageously monitors combustion chamber temperature during the heating period and determines burner condition based on combustion chamber temperatures during the heating period. In this manner, the burner condition can be determined even in cases where steady state temperature is not reached. FIG. 2 is a graph of the temperature of a normally functioning burner "A" during a burner cycle and a burner having degraded function "B," possibly due to LDO fouling. As can be seen from the temperature curves, the normally functioning burner reaches a higher steady state temperature at a quicker rate than the degraded burner.

In some instances, the manner in which the water heater is being operated may cause the temperature of the combustion chamber to increase more slowly even though the burner is functioning properly. For example, when a water heater is called on to provide a continuous supply of hot water of such an amount as to empty the tank, the conditions inside the combustion chamber are such that the burner temperature becomes cooler than during normal operation once the tank is emptied of hot water. This is due in part to condensation in the combustion chamber caused by the marked temperature difference between the cold water surrounding the chamber and the chamber temperature. In this situation, the combustion chamber temperature may cool, possibly triggering an unnecessary shut down. To avoid such nuisance shut downs, the burner control system advantageously delays a shut down until successive operation cycles exhibit decreased combustion chamber temperature.

Figure 1A:
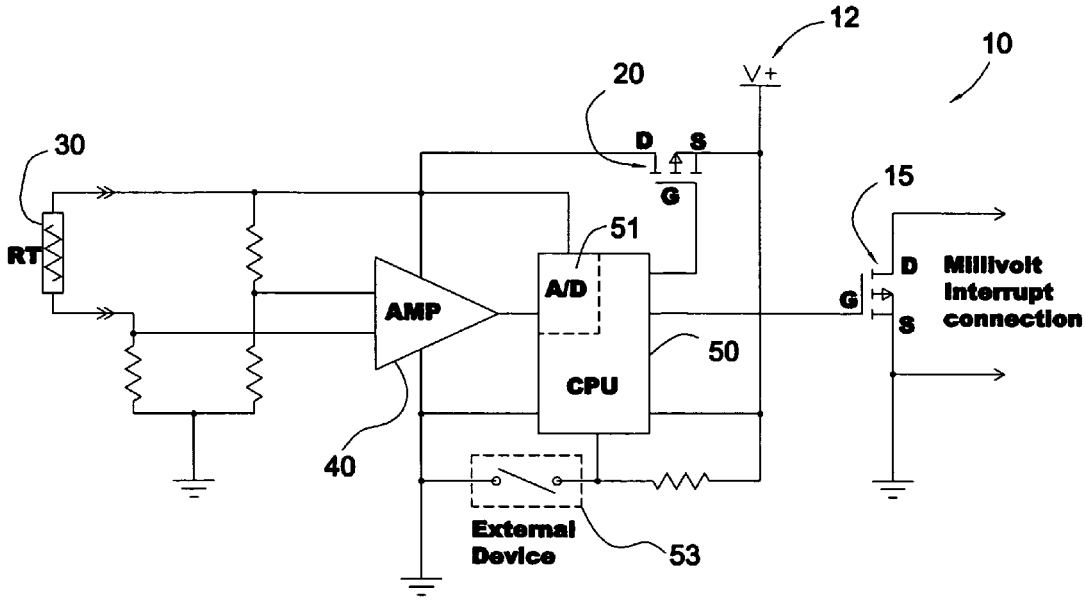
FIGS. 1A-1C are simplified circuit diagrams of a burner interrupt circuits constructed in accordance with embodiments of the present invention incorporating various temperature sensing schemes.
Figure 1B:
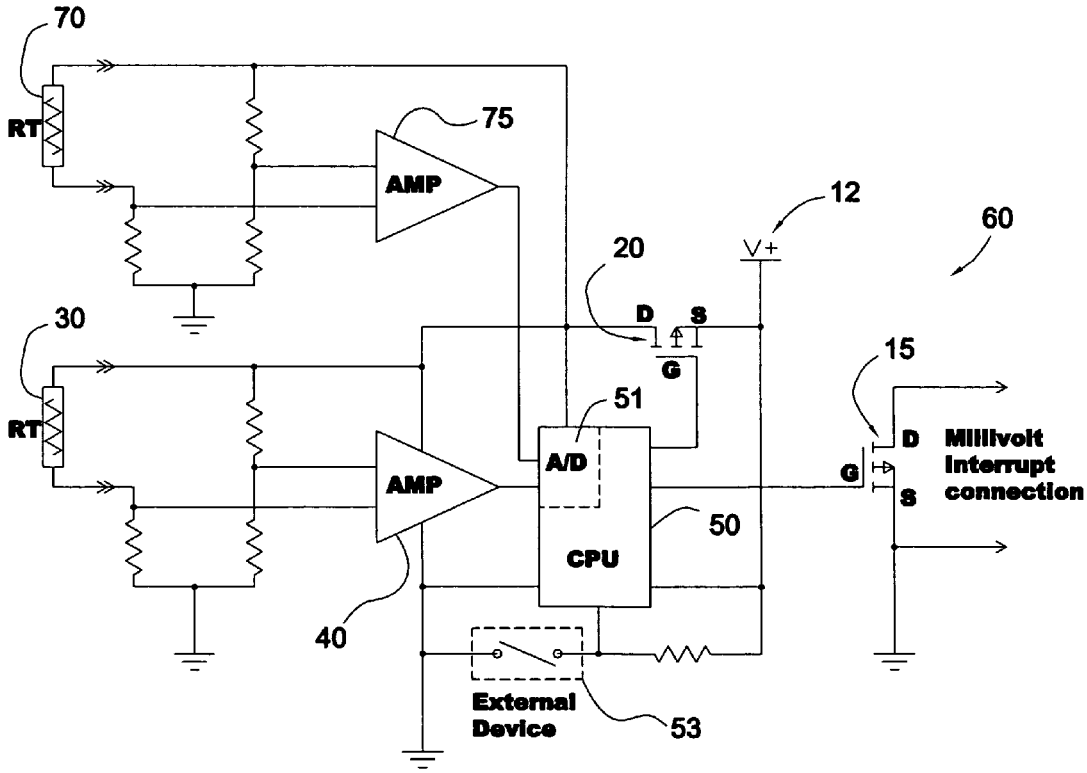
Figure 1C:
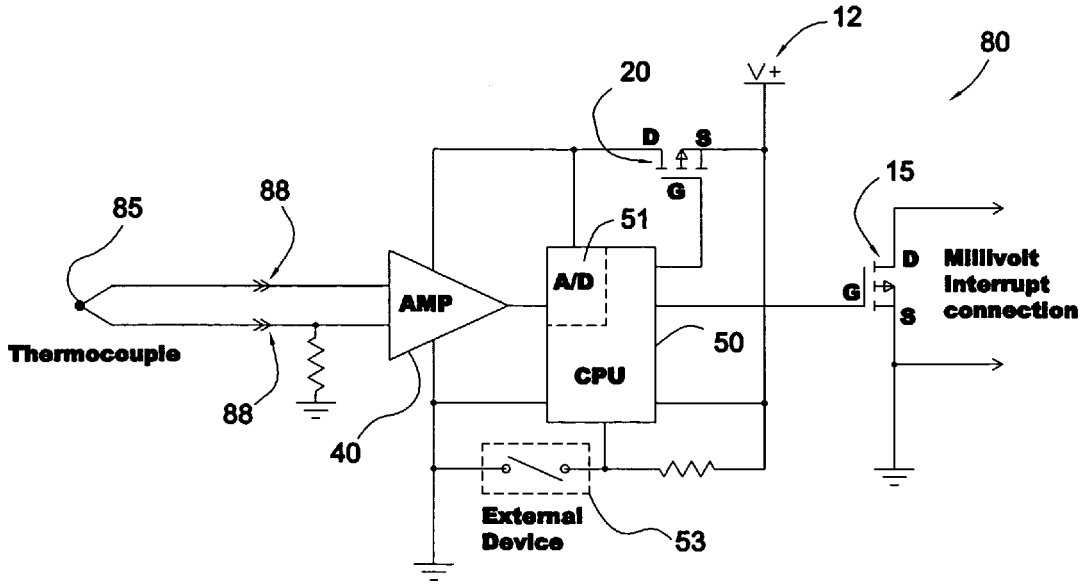

Referring now to FIGS. 1A-1C, burner control interrupt circuits configured for use with a water heater are schematically shown. The control circuit operates a millivolt interrupt connection 15 that allows the supply of fuel to the burner. Once the interrupt connection is activated, the water heater is locked out, requiring a manual reset. A temperature sensing system is mounted within the combustion chamber of a water heater or alternatively on the surface of the combustion chamber. FIG. 1A shows a single resistance thermometer 30 while FIG. 1B shows an additional resistance thermometer 70 that provides an indication of ambient temperature. Each resistance thermometer is part of a bridge circuit, the differential current of which is supplied to an operational amplifier 40, 75. FIG. 1C shows a thermocouple 85 that creates a current that is proportional to its temperature relative to junctions 88. The current is supplied to the operational amplifier 40. One of skill in the art will recognize that other temperature sensing devices can advantageously be employed. The amplified differential current that indicates the temperature of the combustion chamber is provided to a CPU 50 having an analog to digital converter 51. The CPU converts the current data into a combustion chamber temperature and analyzes the temperature data to control the millivolt interrupt connection according to the method that will be described below in connection with FIGS. 3-5.

In addition to controlling the millivolt interrupt connection 15 based on the temperature data, data from one or more external inputs shown schematically as device 53 can prompt the CPU to disconnect the millivolt interrupt connection immediately. The external inputs can include fire monitoring systems, carbon monoxide sensors, central home environmental control systems, or any other sensor that provides information relevant to the functioning of a fuel-fired appliance.

Figure 3:
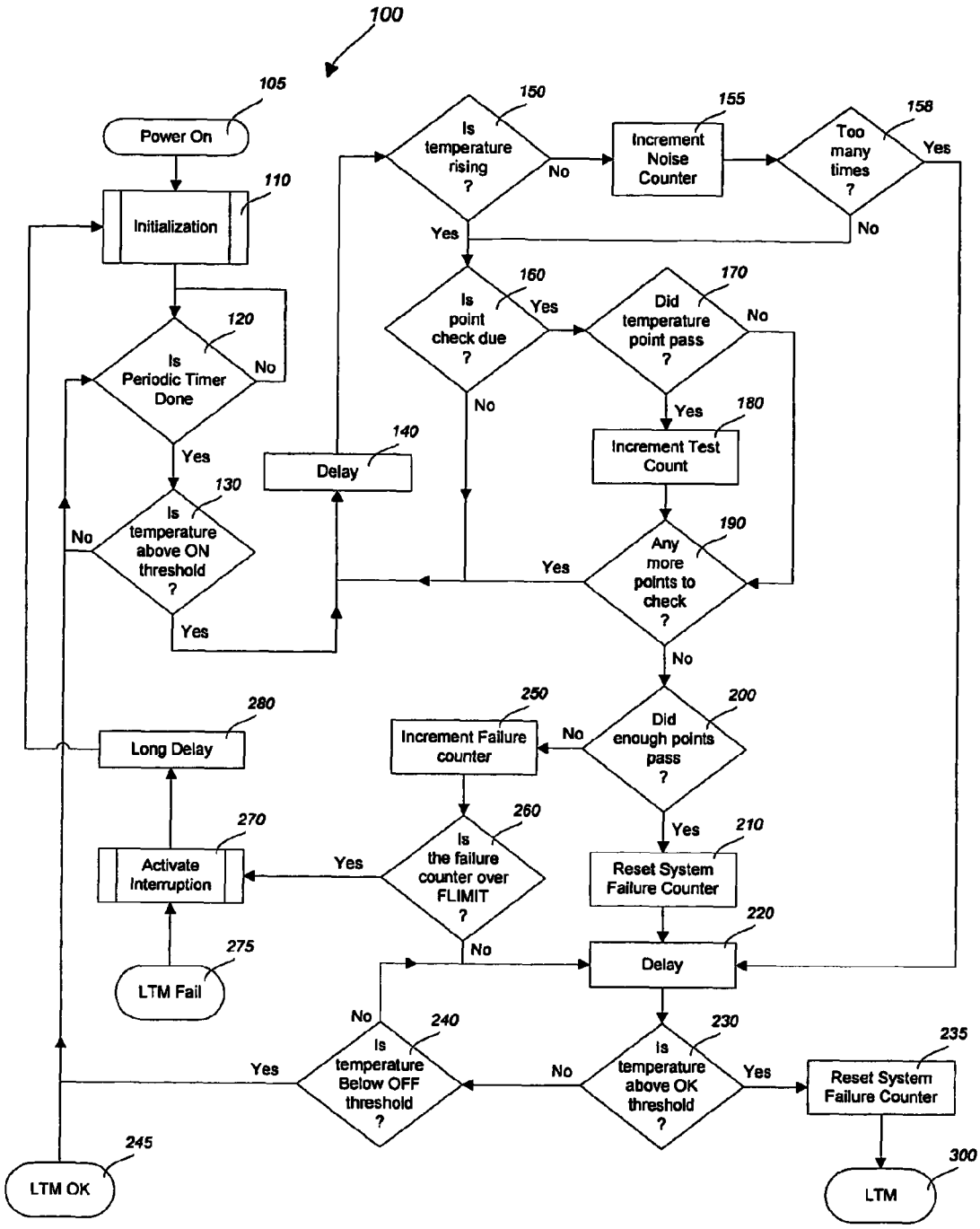
FIGS. 3-5 are a flow chart outlining a method of controlling a burner in accordance with an embodiment of the present invention.

Referring now to FIG. 3, an algorithm for monitoring burner temperature and controlling the millivolt interrupt connection based on the monitored temperature is outlined. At 105 and 110, power is initially turned on. During initialization 110 an LTM FAIL flag is checked. If the LTM FAIL flag is set, the millivolt interrupt circuit is not enabled to conduct and the pilot burner cannot be started. The user can manually reset the water heater, causing this flag to be reset, however an internal counter may be used to limit the number of resets that can occur before the water heater is permanently disabled, requiring a service call.

At 120, a periodic or delay timer is checked to determine if it is time to take a burner temperature reading. Depending on the particular design of the control circuit 10, it may be advantageous to use a relatively long delay time, such as 20 seconds, to minimize CPU power draw. For example, in those instances when the CPU is powered from battery or thermopile, power consumption should be limited and it may be advantageous to employ a microprocessor that is capable of being placed in a "stand-by" or "sleep" power conserving mode in between temperature monitoring operations. This type of power conserving microprocessor is known in the art such as the PIC16F684 made by Microchip Technology, Inc. that features "nanowatt technology." In other instances such as when the CPU is powered by line power, power draw may not be as much of a concern, allowing for shorter delay time between temperature readings. When the periodic timer has expired, the burner temperature is obtained using the "read temperature" method 500 illustrated in FIG. 5. At 510 the gate (20 in FIG. 1) is energized, connecting the operation amplifier 40 to the power source. After allowing for a settling time for the components, the temperature data from the operational amplifier is captured and stored in an array at 520. Multiple temperatures are read and stored according to the decision box 530 until N (in one embodiment N=15) samples are stored. After the temperatures have been read, the amplifier is turned off at 535 to conserve power. Once the array is full of N samples, the values are sorted at 540 and the middle value is selected at 550. At 560 the middle value is compared to an upper limit of burner temperature, the exceeding of which could indicate a flammable vapor ignition event. If the selected temperature is too high, the occurrence of a flammable vapor ignition event is written to memory at 570 and the LTM FAIL flag is set, causing the water heater to be shut down. If the selected temperature is below the upper limit at 560 it is returned at 580.

Returning to FIG. 3, the returned temperature is compared to an ON threshold temperature that would indicate that the burner has been lit at 130. If this temperature indicates that the burner is not lit, the method loops back to wait for the next temperature reading. When a first temperature is read that indicates the burner is lit, the method branches to a delay 140 (for example, 20 seconds) after which a second temperature reading is taken according to the method 500 just described. The first and second temperatures are compared at 150 and if the second temperature is not higher than the first temperature, a noise counter is incremented at 155 and if the noise counter is incremented above a threshold such as 3 at 158 the method branches to a delay 220 followed by decision box 230 that form a short term operation monitoring loop that will be described in detail below.

If at 150 the second temperature is higher than the first temperature, meaning the combustion chamber is heating up, at 160 it is determined if a corresponding check point is stored for the second temperature and if so, the temperature is compared to a stored checkpoint temperature, or range of temperatures, that represent an acceptable range of temperatures for a normally functioning burner at the given time in the heating process at 170. If the temperature point compares favorably to the stored checkpoint, the test counter is incremented at 180 and if there are more checkpoints to be checked, at 190 the method loops back to 140-150 to get another temperature reading. In one embodiment, point checks occur at 2, 3, 4, 5, 7, and 9 minutes. In this manner, the temperature is checked at a proper interval, such as 20 seconds until a predetermined number of points, such as six, have been checked. If there are no more points to check, the test counter value is compared to a threshold number of points that have to exceed their corresponding checkpoint for the present burner cycle to pass at 200. If enough points have passed, a system failure counter is reset at 210 and the method moves to the delay period at 220 that is part of the short term operation monitoring loop. In a self-learning embodiment, a certain number of first appliance cycles would be used to determine the checkpoints stored for use later during monitoring.

If at 200 it is determined that not enough points have passed, the system failure counter is incremented. If the failure counter has a value greater than a preset threshold FLIMIT at 260, the millivolt interrupt connection is disabled and the burner is shut down. After a long delay 280, the burner can be reinitialized 110 by virtue of a manual reset. The resetting of the system failure counter at 210 after any burner cycle in which enough points exceed their checkpoint value requires that the burner must exhibit degraded performance in successive operation cycles, for example 30 cycles, in order for it to be shut down. This reduces the possibility of nuisance shut downs when abnormal operation of the water heater causes the burner temperatures during the heating cycle to fall outside the normal operating range on a single cycle.

Short Term Operation Monitoring Loop

At 230 the temperature is checked against an "OK" temperature that indicates that the combustion chamber has achieved a temperature high enough to indicate that the combustion taking place is acceptable. If the combustion chamber has not yet reached the OK temperature, the temperature is compared to an OFF temperature that would indicate that the burner has been turned off. If the temperature is below the OFF temperature, the method begins waiting for the next one cycle. If the temperature is between the OK temperature at 230 and the OFF temperature at 240, the method loops until the temperature falls outside that range. The method remains in this operation monitoring loop until the water heater is turned off or the temperature becomes high enough to indicate that the water heater is in long term operation, which may happen infrequently during the life of a typically used water heater. It may be advantageous to limit the amount of time the water heater can operate within the short term operation monitoring loop, for example, to ten to twelve hours.

Long Term Operation

Figure 4:
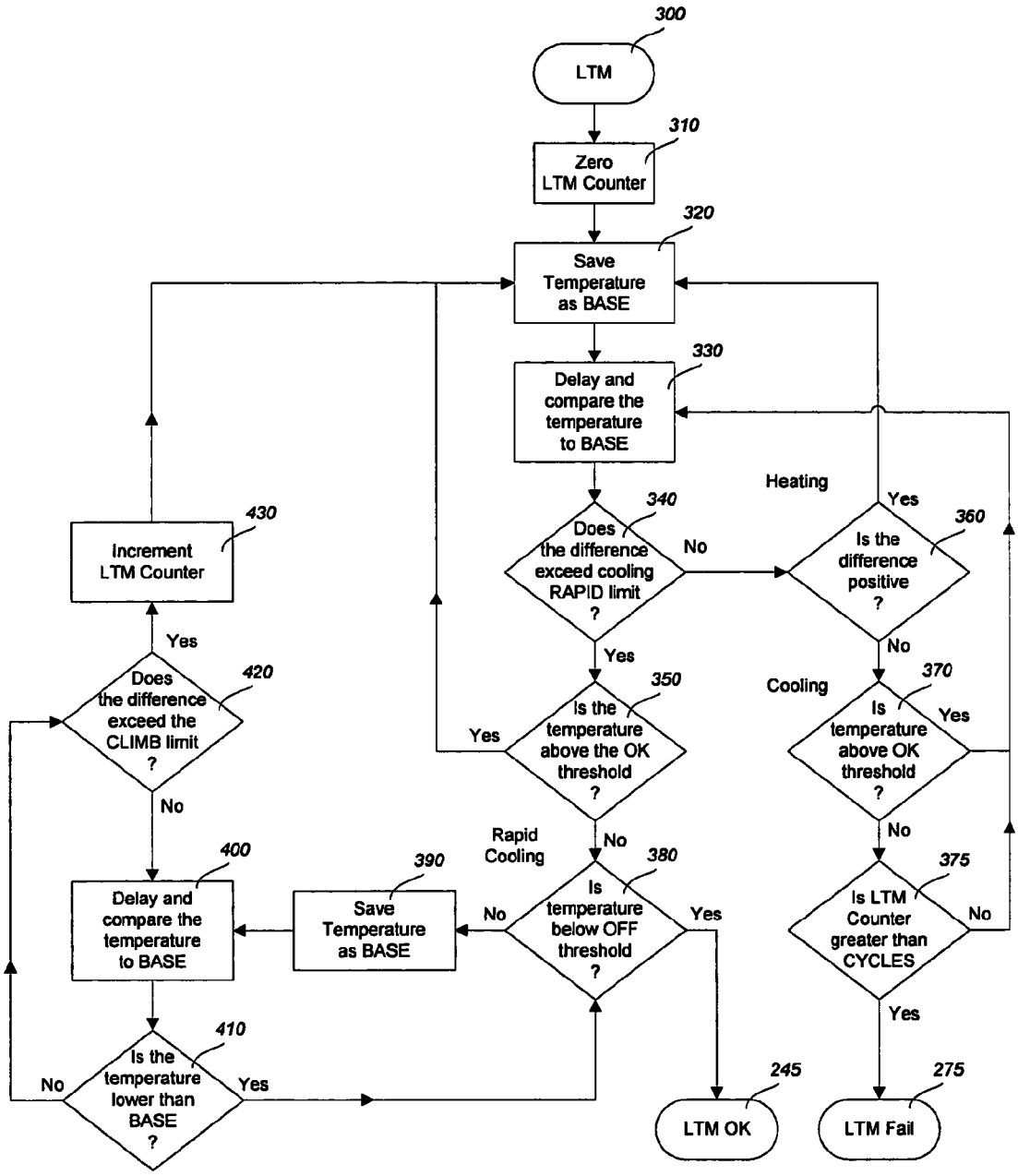
Figure 5:
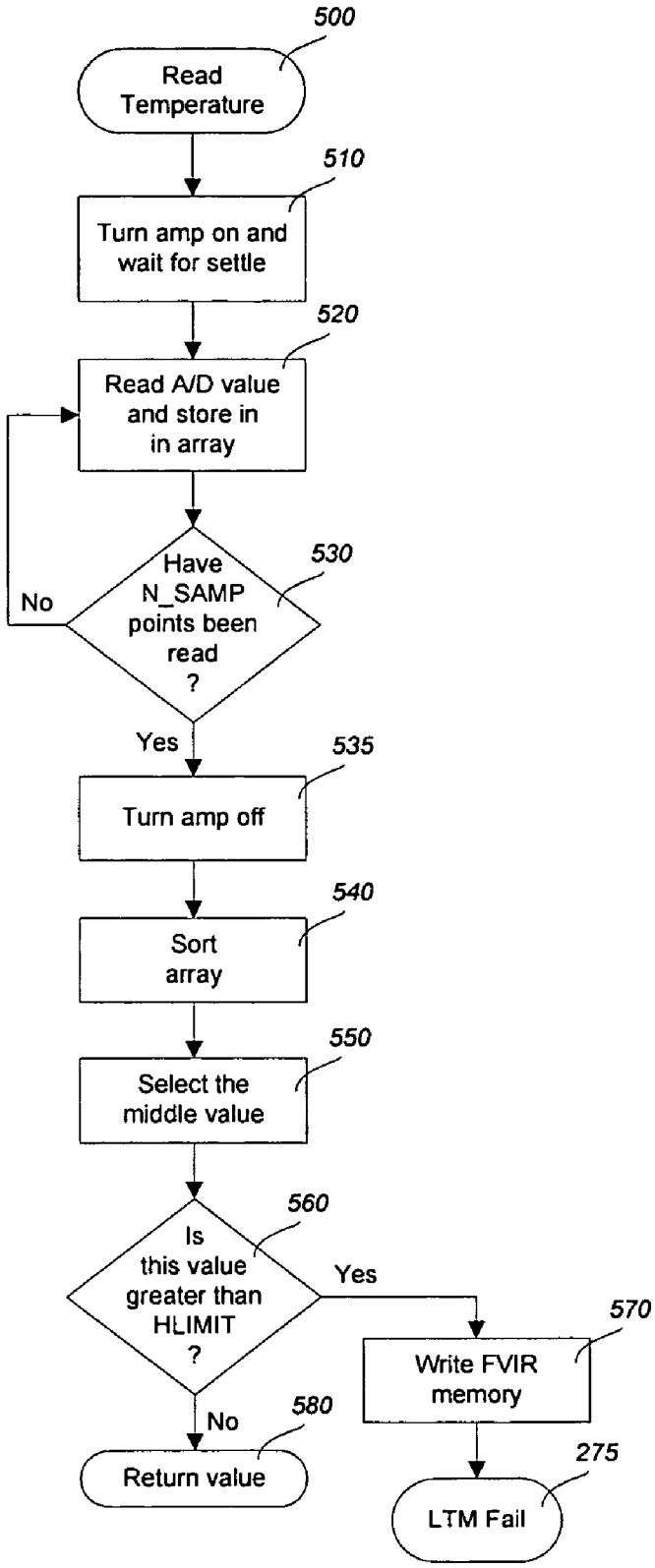

Once the combustion chamber temperature has exceeded the OK threshold in 230, it has been established that the combustion taking place in the current operating cycle is acceptable and excessive carbon monoxide production is not an issue. However, as discussed above, LDO and long on-time operation of a water heater can create decaying temperature conditions within the combustion chamber that are below the OK threshold. The flowchart in FIG. 4 illustrates steps that can be implemented to reduce the likelihood of nuisance shut downs while still effectively monitoring water heater operation cycles that include long on-times broken up by short off-times.

The long term monitoring algorithm "LTM" 300, is entered when the combustion chamber temperature exceeds the OK threshold, meaning that the burner is functioning properly. At 310 an LTM counter is zeroed. At 320, the present combustion chamber temperature is saved as a BASE temperature. At 330, after a delay the present combustion chamber temperature is compared to base to determine if burner is rapidly cooling down at 340. If the burner is rapidly cooling down, at 350 it is determined if the combustion chamber temperature is still above the OK threshold and if so, the method loops back to 320 and the current cooler temperature is stored as a new BASE temperature. If the burner is not rapidly cooling at 340, at 360 it is determined if the burner is heating and if so the new warmer temperature is stored as the BASE temperature. If at 360 it is determined that the burner is cooling down, at 370 a check is made to determine if the combustion chamber temperature is still above the OK threshold and if so, the new cooler temperature is saved as the new BASE temperature. The delay period between successive temperature readings can be set to about 20 seconds. In this manner as long as the combustion chamber temperature is above the OK threshold, the unit will not be shut down.

A falling combustion chamber temperature can indicate either that the unit has been turned off, which would usually involve a relatively consistent cooling down, or that the water heater burner system has become fouled during operation. Returning to 350, if during a rapid cool down the temperature falls below the OK threshold and also the OFF temperature, at 380 the monitoring method determines that the system is functioning properly (the water heater burner was simply turned off) and an LTM OK exit occurs at 245.

While in rapid cooling mode, if the temperature does not fall below the OFF threshold, a rapid cool down loop is entered at 390 that saves the current temperature as the BASE temperature. At 400 the current temperature is taken after a delay, such as 20 seconds, and compared to the BASE temperature. At 410 if the temperature is continuing to fall, the method loops back to 380. If during a rapid cool down event the temperature climbs at a rate exceeding the climb limit as determined at 420, which is an indication that a short off cycle has occurred, at 430 an LTM counter is incremented. The LTM counter is checked at 375 each time the burner cools to below the OK temperature but has not yet entered the rapid cooling phase. By setting CYCLES to a value greater than one, the normal shut off of the appliance burner will not cause an LTM failure trip. This feature allows a number of first CYCLES to be ignored when evaluating LDO temperature decay during long term monitoring. If the LTM counter exceeds CYCLES then at 275 an LTM FAIL flag is set and the unit is shut down.

While the present invention has been described with a degree of particularity, it is the intent that the invention includes all modifications and alterations from the disclosed design falling with the spirit or scope of the appended claims.

I claim:

1. A method for use with a water heater that includes a combustion chamber enclosing a burner for selectively disabling the burner when certain criteria are met, the method comprising:

determining that the burner is lit during a first heating cycle in said combustion chamber of said water heater;

monitoring a temperature of the combustion chamber while the burner is lit during said first heating cycle;

comparing a rate at which the temperature is increasing in the combustion chamber to a threshold rate during said first heating cycle;

comparing a rate at which the temperature is increasing in the combustion chamber to a threshold rate during at least one other heating cycle; and disabling the lit burner only if the rate of change of temperature is below a threshold rate during both the first heating cycle and the at least one other heating cycle.

2. The method of claim 1 wherein disabling the lit burner requires a manual reset in order to operate the burner.

3. The method of claim 2 comprising counting the number of manual resets and permanently disabling the burner when the number of manual resets reaches a predetermined amount.

4. For use with a water heater that includes a combustion chamber enclosing a burner, a method that selectively disables the burner when the burner is fouled, the method comprising:

monitoring a temperature of the combustion chamber of said water heater while the burner is lit during a first heating cycle;

comparing a rate of combustion temperature increase to a threshold rate during said first heating cycle;

comparing a rate of combustion temperature increase to said threshold rate during at least one other heating cycle;

providing a microprocessor for performing the monitoring and comparing steps;

providing a thermopile for powering the microprocessor; and disabling the lit burner when the burner is fouled only if the rate of combustion chamber temperature increase is below said threshold rate during both the first heating cycle and the at least one other heating cycle by interrupting a millivolt connection between the burner and a fuel supply device.

5. The method of claim 4 wherein disabling the lit burner requires a manual reset in order to operate the burner.

6. The method of claim 5 comprising counting the number of manual resets and permanently disabling the burner when the number of manual resets reaches a predetermined amount.

7. A burner control system that disables a burner enclosed by a combustion chamber in a water heater appliance when the burner is fouled, the control system comprising:

a temperature monitor that monitors a temperature of the combustion chamber of said water heater appliance while the burner is lit during a heating cycle;

an interrupt circuit that selectively disables the communication of fuel to the burner;

a thermopile providing a source of electrical power; and a microprocessor powered by the thermopile that receives signals from the temperature monitor during a heating cycle and compares a rate at which the temperature increases in said combustion chamber to a threshold rate;

the microprocessor activating the interrupt circuit to disable a fouled burner when the rate at which the temperature of said combustion chamber increases is below a threshold rate during at least two heating cycles.

8. A method for use with a water heater that includes a combustion chamber enclosing a burner for selectively disabling the burner when certain criteria are met, the method comprising:

determining whether the burner in said combustion chamber of said water heater is lit in a heating cycle;

monitoring a temperature of the combustion chamber during the heating cycle;

comparing the temperature to a threshold temperature at a first predetermined time during said heating cycle; and comparing the temperature to said threshold temperature at a first predetermined time during a subsequent heating cycle; and disabling the lit burner only if the temperature is below the threshold temperature during both the first and subsequent heating cycles.

9. The method of claim 8 wherein the temperature is compared to the threshold temperature at each of a plurality of predetermined times, the burner being disabled if the temperature is below the threshold temperature a predetermined number of times.

10. The method of claim 8 further comprising:

comparing the temperature to the threshold temperature at each of a plurality of predetermined times;

incrementing a counter each time the temperature is below the threshold temperature; and disabling the burner if the counter reaches a predetermined amount.

11. A method for selectively disabling a burner located in a water heater combustion chamber comprising the steps of:

a) determining whether the burner of said water heater combustion chamber is lit during heating cycles;

b) after determining that the burner is lit, monitoring the combustion chamber temperature during said heating cycles;

c) comparing the rate of temperature increase in said combustion chamber to a predetermined rate of increase, during said heating cycles; and d) disabling the burner only if the rate of temperature increase fails to reach said predetermined rate of temperature increase for at least two heating cycles.

12. The method of claim 11 wherein said burner is disabled only if it fails to reach said threshold rate of increase for a plurality of heating cycles.

13. A method for selectively disabling a burner located in a water heat combustion chamber comprising the steps of:

a) determining whether the burner of said water heater combustion chamber is lit during heating cycles;

b) after determining that the burner is lit, monitoring the combustion chamber temperature during said heating cycles;

c) comparing said combustion chamber temperature to a predetermined threshold temperature that is indicative of the proper operation of a lit burner; and d) disabling the burner only if the combustion chamber temperature fails to reach said predetermined temperature for at least two heating cycles.

14. The method of claim 13 wherein said burner is disabled when it is lit.

15. The method of claim 13 wherein the monitoring and comparing steps are provided by a microprocessor.

16. The method of claim 15 wherein power for said microprocessors is provided by a thermopile.

17. The method of claim 13 wherein said burner is disabled only if it fails to reach said threshold temperature for a plurality of heating cycles.

* * * * *